United States Patent [19]

Dane

[11] 4,077,470

[45] Mar. 7, 1978

[54] WELL CENTRALIZER AND METHOD OF MAKING

[75] Inventor: Burlie Newton Dane, Weatherford, Tex.

[73] Assignee: Weatherford/Lamb, Inc., Houston, Tex.

[21] Appl. No.: 762,907

[22] Filed: Jan. 27, 1977

[51] Int. Cl.[2] ..... E21B 17/10

[52] U.S. Cl. ..... 166/244 R; 166/241

[58] Field of Search ..... 166/172, 241, 244 R

[56] References Cited

U.S. PATENT DOCUMENTS 3,356,147 12/1967 Dreyfuss ..... 166/241

FOREIGN PATENT DOCUMENTS 2,545,181 4/1976 Germany ..... 166/241

*Primary Examiner*—James A. Leppink

*Attorney, Agent, or Firm*—Fulbright & Jaworski

[57] ABSTRACT

A well centralizer and method of making having axially spaced collars for attachment about a casing and a plurality of outwardly bowed elements connected to each collar. Each end of the bows has a generally U-shaped offset which is connected in a circumferential opening in a collar and a locking tab extends from the collar inside of the offset and extends through the collar opening between the bow offset and the collar and locks the offset in the collar opening. The axial portions of the collar on each side of the opening are radially recessed outwardly for receiving one end of the bowed element and the length of the locking tab is sufficiently long to extend through the opening and engage the outside of the collar to firmly and securely lock the bow in place and maintain a consistent internal diameter of the centralizer collar. The collars and bows are easily assembled in the field by insertion of the bow ends into the collar and pressing the free end of each locking tab about a bow end.

7 Claims, 10 Drawing Figures

WELL CENTRALIZER AND METHOD OF MAKING

BACKGROUND OF THE INVENTION

The present invention is directed to a well centralizer which is mounted on oil well casings for maintaining substantially uniform clearance between the casing and the well bore. Such centralizers, as generally shown in U.S. Pat. No. 3,356,147, include a pair of axially spaced collars for connection about the casing and each collar is connected to one end of a bowed element such as bowed leaf springs which are circumferentially spaced about the collars. While it is desirable that the attachment of the bow springs to the collars be a non-welded connection in order to avoid the problems involved with welded joints, it is also important that the connection between the bowed elements and the collars be secure and also maintain a consistent interior diameter for attachment to the casing.

While the centralizer of the above-mentioned patent has proved satisfactory, the cantilevered tongues for holding the bow springs to the collars do have problems in that the cantilevered tongues become loosened and fail to securely hold the bows prior to installation on the casing and also change the internal diameter of the collars.

SUMMARY

The present invention is directed to a well centralizer and method of making in which an improved means for connecting the bowed elements to the collars is provided.

Another object of the present invention is the provision of a centralizer having axially spaced collars for attachment to a casing and a plurality of outwardly bowed elements connected to each collar by providing an improved connecting means between each end of the bowed elements and one of the collars. The connecting means includes a circumferential opening in the collar which accepts a generally U-shaped offset in the end portion of a bowed element and a locking tab extends from the collar across the inside of the offset and extends through the opening between the offset and the collar thereby locking the offset in the opening and locking the locking tab in a holding position.

Still a further object of the present invention is the provision of a collar which can be made in halves for ease of shipping but which can be easily assembled into a centralizer in the field and which includes a semi-circular collar half having connecting means at each end for connection to another semi-circular collar half. Each collar half includes a plurality of circumferential openings with a locking tab extending from the collar half from each side of each opening and the locking tab is bent inwardly of the collar half for allowing the insertion of one end of a bowed element, and the free end of each locking tab is bent toward the collar half whereby when the end of a bowed element is inserted into the opening and the locking tab is pressed against the bowed element, the free end of the locking tab will pass through the opening between the bowed element and the collar half and lock the bowed element as well as the locking tab in place.

Another object of the present invention is the provision of an improved method of making a centralizer having a collar and a connected bowed element by stamping two substantially parallel slots in a portion of the collar with the slots being longer than the width of the bowed elements, cutting a line in the collar between said parallel slots at one end of the slots thereby forming a locking tab positioned in an opening between the slots, bending the free end of the locking tab toward the outside of the collar portion, recessing the part of the collar on either side of the opening outwardly for receiving one end of a bowed element, moving the locking tab inwardly of the collar portion for allowing insertion of one end of the bowed element between a locking tab and the collar recess part, installing one end of a bowed element having a U-shaped offset in the collar recess with the U-shaped offset positioned in the opening and outside of the locking tab, and pressing the locking tab toward the bowed element and passing the free end of the locking tab through the opening and between the bowed element and the collar thereby locking the bowed element in the opening.

Other and further objects, features and advantages will be apparent from the following description of a presently preferred embodiment of the invention, given for the purpose of disclosure and taken in conjunction with the accompanying drawings.

BRIEF DESCRIPTION OF THE DRAWINGS

FIG. 3 is a cross-sectional view taken along the line 3—3 of FIG. 2, FIGS. 4–8 illustrate the method of making the improved connection between the collars and the bowed elements of a centralizer on a portion of a collar wherein.

DESCRIPTION OF THE PREFERRED EMBODIMENT

Figure 1:
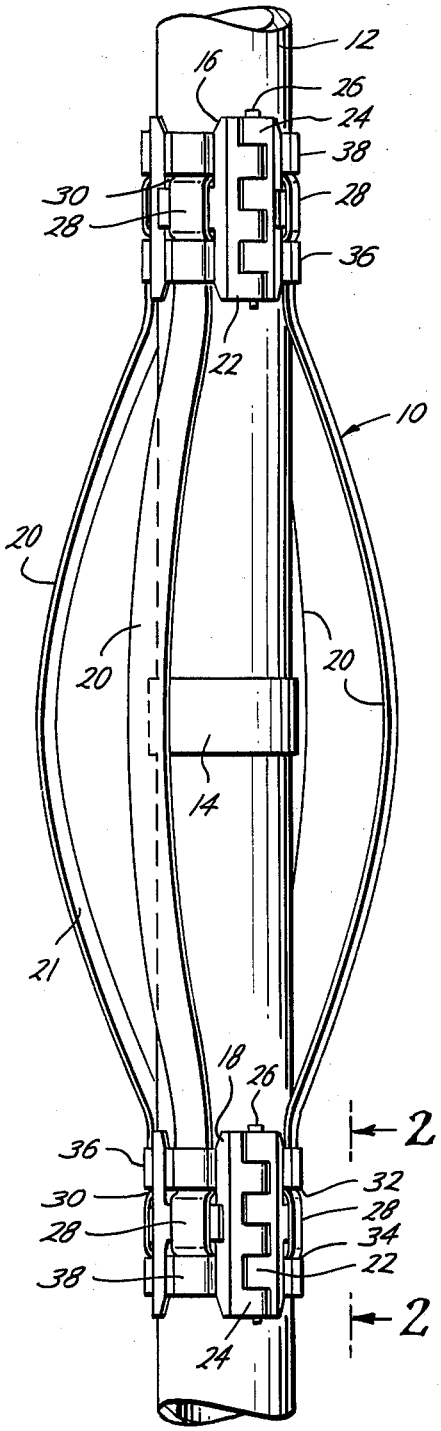
FIG. 1 is an elevational view showing the centralizer of the present invention mounted on a well casing.

Referring now to the drawings, particularly to FIG. 1, the reference numeral 10 generally indicates the improved centralizer of the present invention and is shown installed on a well casing 12 in which longitudinal movement on the casing 12 is limited by any suitable means such as a stop collar 14. The centralizer 10 generally includes axially spaced collars 16 and 18, each of which supports one end of a plurality of bowed elements 20, such as bow springs made of spring steel straps. Preferably, the collars 16 and 18, which may be identical, are formed of two semicircular parts, each of which includes connecting means 22 and 24 at opposite ends, such as hinges, whereby the semi-circular collar halves may be connected to another semi-circular collar half by pins 26 to form a circular collar.

Figure 2:
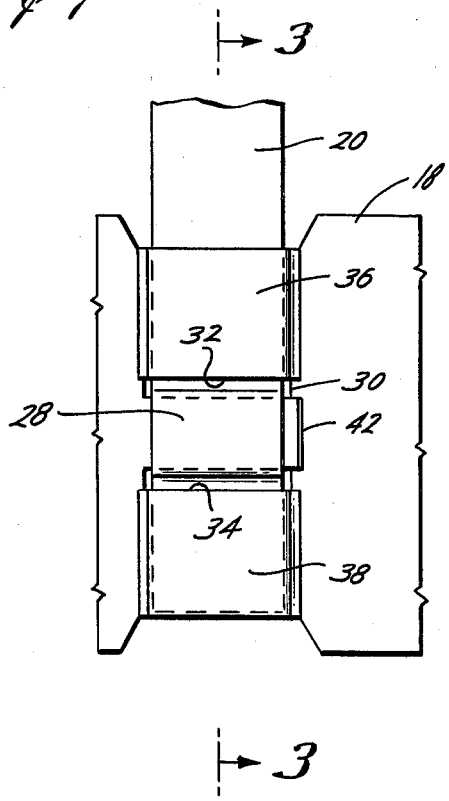
FIG. 2 is an enlarged cross-sectional view taken along the line 2—2 of FIG. 1.
Figure 3:
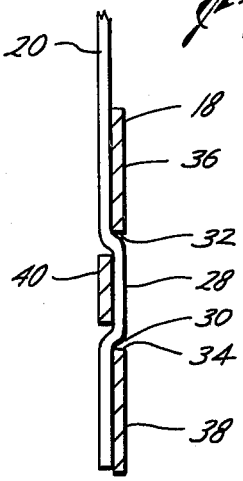

Each bowed element 20 includes a U-offset 28 in each end which coacts with the collars 16 or 18 to connect the ends of the bows 20 securely to the collars 16 and 18 and prevent release of the bow springs 20 from the collars 16 and 18. Annularly spaced about the collars are a plurality of circumferential openings 30 forming opposing shoulders 32 and 34 as best seen in FIGS. 1, 2 and 3. The openings 30 are sized to receive the bow spring offset 28 between the shoulders 32 and 34. Preferably, the axial portions 36 and 38 of the collars on either side of the openings 30 are radially offset outwardly a distance approximately equal the thickness of the bow springs 20 so that the inside face 21 of the ends of the bow springs 20 generally form a smooth interior diameter with the interior of the collars 16 and 18 to form a generally circular mating surface to coact with the exterior of the casing 12.

A locking tab 40 is provided which extends from a collar from one side of each opening 30 across the inside of a bow spring offset 28 and extends through the opening 30 between the offset 28 and the collar thereby locking the offset 28 in the opening 30 as well as locking the free end 42 of the locking tab 40 in a holding position.

Figure 4:
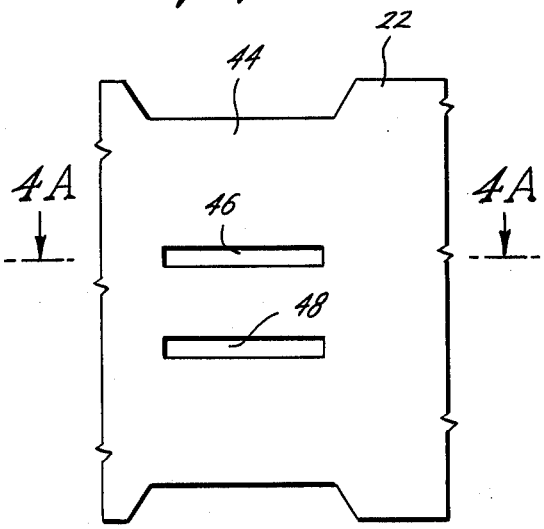
FIG. 4 is an elevational view illustrating the initial stamping on either side of the locking tab.
Figure 4A:
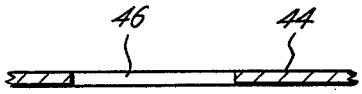
FIG. 4A is a cross-sectional view taken along the line 4A—4A of FIG. 4.

Referring now to FIGS. 4–8, the method of manufacture of the improved centralizer 10 of the present invention and particularly the method and structure of the connection between the collars 16 and 18 and one end of the bow springs 20 is best seen. Referring particularly to FIGS. 4 and 4A, a portion 44 of one of the half collar blanks, such as of half collar 22, is seen, in which for clarity, only the method of manufacture and assembly of one end of one of the bow springs 20 to a half collar is illustrated. FIGS. 4 and 4A show that the portion 44 is stamped to create two longitudinal slots 46 and 48 in which the length of the slots 46 and 48 is longer than the width of the bowed element 20 and are generally transverse to the longitudinal axis of the half collar 22.

Figure 5:
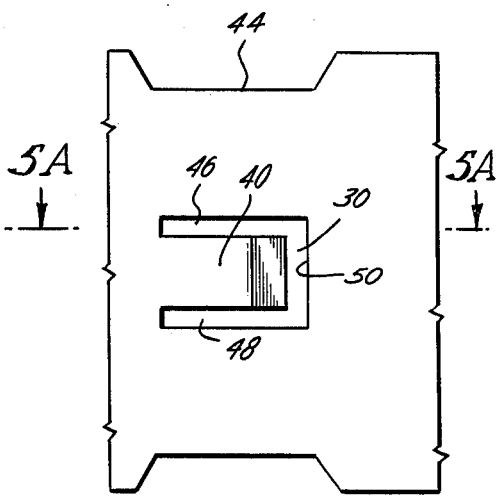
FIG. 5 is an elevational view of a portion of a collar illustrating the method of shearing the end and bending the end of the locking tab outwardly.
Figure 5A:
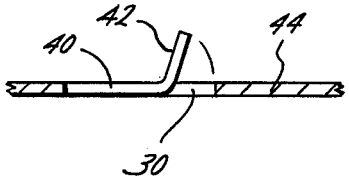
FIG. 5A is a cross-sectional view taken along the line 5A—5A of FIG. 5.

Referring now to FIGS. 5 and 5A, a line 50 is cut in the collar portion 44 between the parallel slots 46 and 48 and at one end of the slots 46 and 48 thereby forming the opening 30 shown in FIGS. 1–3 which later in the process of manufacturing receives the offset 28 of one end of one of the bow springs 20. Also, cutting the line 50 forms the locking tab 40 which extends from the collar half 22 from one side of the opening 30 and terminates in its free end 42. It is to be noted that cutting the line 50 does not shorten the length of the tab 40, as occurs in the prior patent above described, but to the contrary insures that the length of the tab 40 will be sufficient to accomplish its locking function as hereinafter described. And in forming the locking tab 40, the free end 42 is bent toward the outside of the collar portion 44 in order to perform its locking function as will be more fully described hereinafter.

Figure 6:
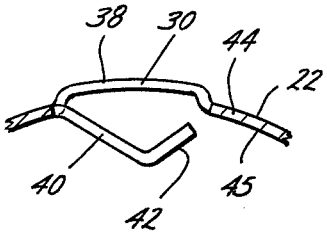
FIG. 6 is a top elevational view of a portion of a collar in which the collar is arcuately formed and the locking tab is bent inwardly to allow the insertion of one end of a bowed element into the recess.

Referring now to FIG. 6, the collar portion 44 is pressed to recess the axial parts 36 and 38 on either side of the opening 30 outwardly a distance substantially equal to the thickness of bow spring 20 whereby the recess portions 36 and 38 will receive the bow spring 20 and the inside 21 of the bow spring 20 will substantially form an internal diameter with the interior 45 of the collar 22 to mate with the exterior diameter of the casing 12. Also in FIG. 6, the collar portion 44 is arcuately formed and the collar 22 in its entirety is formed in a semi-circle. In addition, in the steps shown in FIG. 6, the locking tab 40 is moved inwardly of the collar portion 44 to allow room for insertion of one end of a bowed element 20 between the locking tab 40 and the collar recess parts 36 and 38.

Figure 7:
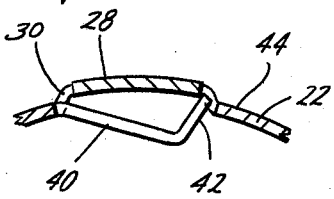
FIG. 7 is a top elevational view showing the next step of the process of manufacture in which the bow element is installed in the collar and the locking tab is being pressed toward a closed position.

Referring now to FIG. 7, one end of a bow spring 20 is installed in the recessed part of the portion 44 of collar 22 against the parts 36 and 38 with the offset 28 positioned in the opening 30. Then the locking tab 40 is pressed toward the offset 28. It is noted that since the opening 30 is longer than the width of the bow spring 20, that there is space in the opening 30 between the offset 28 and the portion 44 of the half collar 22 into which the free end 42 of the locking tab 40 may be pressed. Thus, as the tab 40 is pressed against the offset 28, the free end 42 which has been bent sufficiently to clear the collar portion 44 will contact the offset 28 and take the path of least resistance and pass into the space in the opening 30 between the offset 28 and the collar portion 44.

Figure 8:
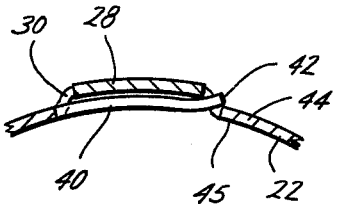
FIG. 8 is a top elevational view illustrating the bow element installed and locked in a portion of a collar with the locking tab securely locked in position.

Referring now to FIG. 8, the final step in the method of connection of one end of a bow spring 20 to the collar half 22 is shown in which the locking tab 40 has been pressed against the bow spring offset 28 and the free end 42 of the locking tab 40 extends through the opening 30 and against the back of the collar portion 44 to securely lock the offset 28 in the opening 30 as well as locking the locking tab 40 in a locked position whereby even the rough handling of equipment which occurs in the oil field will not cause the locking tab 40 to become disengaged. Furthermore, since the locking tab 40 is securely maintained in its closed position, its interior surface will maintain a consistent internal diameter with the interior surface 45 of the half collar 22 for coacting with the exterior of a casing 12 instead of protruding into the interior of the collar. It is also to be noted that even though the locking tab 40 as originally formed in FIGS. 4 and 5 is no longer than the length of the opening 30, that when the recess on parts 36 and 38 are formed, as best seen in FIG. 6, the length of the locking tab 40 is longer than the circumferential extent of the opening 30 whereby the free end 42 of the locking tab 40 may extend through the opening 30 and perform its locking function.

From the above description of the structure and method of manufacturing and assembling the improved centralizer 20 of the present invention, the method of manufacture should be readily apparent. However, the method comprehends making a centralizer and parts thereof in which the centralizer has axially spaced collars and connected bow elements therebetween, and includes stamping in a plurality of locations in each collar two substantially parallel slots with the slots being longer than the width of the bowed element, cutting a line in each collar between each pair of parallel slots at one end of the slots thereby forming a locking tab positioned in an opening between each pair of slots, bending the free end of each tab toward the outside of the collar portions, recessing the axial parts of each collar on each side of each opening outwardly for receiving one end of a bowed element, moving the locking tab inwardly of the collar for allowing insertion of one end of a bowed element between each locking tab and a collar recess, installing one end of a bowed element having a U-shaped offset in each collar recess with the U-shaped offset positioned in an opening and outside of a locking tab, and pressing the locking tabs toward the bowed elements and passing the free ends of the locking tabs through an opening and between a bowed element and a collar thereby locking the bowed elements in the opening. The method further comprehends making the bowed elements and half collars and assembling the centralizer in the field to reduce transportation costs in which event the steps of FIGS. 7 and 8 would be performed in the field.

The present invention, therefore, is well adapted to carry out the objects and attain the ends and advantages mentioned as well as others inherent therein. While a presently preferred embodiment of the invention is given for the purpose of disclosure, numerous changes in the detail of construction, arrangement of parts, and steps of the method of manufacture, will readily suggest themselves to those skilled in the art and which are encompassed within the spirit of the invention and the scope of the appended claims.

What is claimed is:

1. In a centralizer having axially spaced collars for attachment about a casing and a plurality of outwardly bowed elements connected to each collar, the improvement in connecting means between one of said bowed elements and one of said collars comprising, a circumferential opening in said collar forming opposing shoulders on opposite sides of the opening, a generally U-shaped offset in the end portion of said bowed element positioned in said opening, and a locking tab extending from the collar across the inside of said offset and extending through the opening between the offset and the collar thereby locking the offset in the opening and locking the locking tab in a holding position.

2. The apparatus of claim 1 wherein length of the locking tab is longer than the circumferential extent of said opening.

3. In a centralizer having axially spaced collars for attachment about a casing and a plurality of outwardly bowed elements connected to said collars, the improvement in connecting means between each end of each of said bowed elements and one of said collars comprising, portions of the collar being radially recessed outwardly for receiving one end of each bowed element, a circumferential opening in each recessed portion forming opposing shoulders on opposite sides of the opening, said opening being longer than the width of the bowed element, a generally U-shaped offset in the end portion of each bowed element positioned in one of said openings and held against longitudinal movement by said opposing shoulders, and a locking tab extending from the collar across the inside of the offset and extending through the opening between the offset and the collar thereby locking the offset in the opening.

4. The apparatus of claim 3 wherein the length of the locking tab is longer than the circumferential extent of said opening wherein the tab extends through the opening and engages the outside of the collar to securely lock the tab and bowed element in place.

5. One half of a collar for use in a centralizer which has axially spaced collars and connected bowed elements comprising, a semi-circular collar half having connecting means at each end for connection to another semi-circular collar half, said collar half having a plurality of circumferential openings, each opening forming opposing shoulders axially spaced on opposite sides of the opening, the parts of the collar half on each axial side of each opening being recessed outwardly for receiving one end of a bowed element, a locking tab extending from the collar half from one side of each opening, said locking tabs being bent inwardly of the collar half for allowing the insertion of one end of a bowed element between a locking tab and a collar recess, the free end of each locking tab being bent toward the collar half whereby when an end of a bowed element is inserted in a recess, and the locking tab is pressed against the bowed element the free end will pass through the opening between the bowed element and the collar half and lock the element and the tab in place.

6. In the method of making a centralizer having a collar and a connected bowed element, the improvement comprising, stamping two substantially parallel slots in a portion of the collar, said slots being longer than the width of the bowed element and generally transverse to the longitudinal axis of the collar, cutting a line in the collar between said parallel slots at one end of said slots thereby forming a locking tab positioned in an opening between said slots, bending the free end of said tab toward the outside of said collar portion, recessing the part of the collar on either side of the opening outwardly for receiving one end of a bowed element, moving the locking tab inwardly of the collar portion for allowing insertion of one end of the bowed element between the locking tab and the collar recessed part, installing one end of a bowed element having a U-shaped offset in the collar recess with the U-shaped offset positioned in the opening and outside of said locking tab, and pressing the locking tab toward the bowed element and passing the free end of the locking tab through the opening and between the bowed element and the collar thereby locking the bowed element in the opening.

7. In the method of making a centralizer having axially spaced collars and connected bowed elements, the improvement comprising, stamping in a plurality of locations in each collar two substantially parallel slots, said slots being longer than the width of the bowed elements, cutting a line in each collar between each pair of parallel slots at one end of said slots thereby forming a locking tab positioned in an opening between each pair of slots, bending the free end of each tab toward the outside of said collar portion, recessing the axial parts of each collar on each side of each opening outwardly for receiving one end of a bowed element, moving the locking tab inwardly of the collar for allowing insertion of one end of a bowed element between each locking tab and a collar recess, installing one end of a bowed element having a U-shaped offset in each collar recess with the U-shaped offset positioned in an opening and outside of a locking tab, and pressing the locking tabs toward the bowed elements and passing the free ends of the locking tabs through an opening and between a bowed element and a collar thereby locking the bowed elements in the openings.

* * * * *